33-261
11/15/83 XR SR 4,414,751

United States Patent [19]
Mathews

[11] 4,414,751
[45] Nov. 15, 1983

[54] BOW SIGHT

[76] Inventor: Nicholas A. Mathews, 234 Plumb St., Milton, Wis. 53563

[21] Appl. No.: 286,385

[22] Filed: Jul. 24, 1981

[51] Int. Cl.[3] ..... F41G 1/46
[52] U.S. Cl. ..... 33/265; 33/261
[58] Field of Search ..... 33/265, 255, 261, 254, 33/252, 256, 258, 266

[56] References Cited

U.S. PATENT DOCUMENTS

| | | | |
|---|---|---|---|
| 462,475 | 11/1891 | Dobbel | 33/255 |
| 1,408,276 | 2/1922 | Eickhoff | 33/265 |
| 3,310,875 | 3/1967 | Kowalski | 33/265 |
| 3,696,517 | 10/1972 | Larson | 33/265 |
| 4,305,208 | 12/1981 | Larson | 33/265 |

*Primary Examiner*—William D. Martin, Jr.
*Attorney, Agent, or Firm*—Andrus, Sceales, Starke & Sawall

[57] ABSTRACT

A bow sight includes a sight assembly having a supporting block provided with a transverse bore which slidably receives a spring loaded sighting pin for movement between a sighting position and a nonsighting position. A latch is pivoted on the block for releasable engagement with the sighting pin so that when engaged the pin is held in its nonsighting position, and when disengaged the spring forces the pin to its sighting position. A plurality of such assemblies may be mounted on a base plate in vertically spaced arrangement and the base plate in turn may be mounted on a bow to provide a device for sighting targets at various ranges.

7 Claims, 5 Drawing Figures

BOW SIGHT

BACKGROUND OF THE INVENTION

This invention relates to archery bows, and more particularly to a bow sight used for sighting targets at various ranges.

Bow sights are employed to facilitate the sighting or aiming of an arrow at different ranges. For hunting or target shooting purposes a bow sight must be capable of compensating for distance from the target as well as for windage. Windage relates to lateral adjustments which must be made by the archer depending upon wind conditions and the individual archer's shooting techniques and equipment.

Various bow sights have been provided by the prior art. One such device employs a single sighting element which is slidable along a track mounted on the bow. See for example U.S. Pat. No. 2,654,152. Another type of sighting device, such as that shown in U.S. Pat. No. 3,310,875, employs a plurality of sighting elements disposed in vertically spaced arrangement above the arrow receiving portion of the bow. In U.S. Pat. No. 4,162,579 a sighting device is disclosed which utilizes a rotary member having a plurality of different sighting pins projecting radially therefrom in angularly spaced relationship.

SUMMARY OF THE INVENTION

An improved bow sight enables an archer to shoot with a high degree of accuracy. The bow sight provides ready adjustment to compensate for different shooting distances as well as for windage. A sight assembly includes a sight support, a spring loaded sighting pin mounted on the sight support and movable between a sighting position and a nonsighting position, and latch means mounted on the sight support for releasable engagement with the sighting pin.

The latch includes a lever pivotally mounted on the sight support. The lever has a pin engaging tip pivotable between an operative position engaged with the sighting pin to hold the pin in its nonsighting position, and an inoperative position disengaged from the pin which releases the pin so that the spring forces the pin to its sighting position. Thus, a lever is manually actuated to release the sighting pin to provide a bow sight that can be quickly and easily operated without any complicated release mechanism.

The bow sight also provides means for readily and quickly adjusting the sighting pin to compensate for both distance from a target and windage. Preferably, the sight support for each sight assembly is in the form of a block having a transverse bore formed therethrough that slidably receives the sighting pin. The supporting block includes a pair of legs which straddle a base plate attached to the bow. Each leg has a mounting screw therein which permits the sight assembly to be securely mounted on the bow at any desired distance above the arrow rest. Thus, a plurality of such sight assemblies are positioned at different vertically spaced distances above the arrow rest of the bow so that an archer may quickly find the proper range and accurately shoot an arrow at a target. This readily enables an archer to compensate for distance from the target. Windage is compensated for by means of an adjusting knob threadedly engaged on the sighting pin. The adjusting knob moves a stop member also located on the sighting pin which in turn engages the supporting block when the pin moves to its sighting position to limit the extent to which the pin projects laterally from the block.

The sighting pin includes a latching face that engages the pin engaging portion of the latch means when the sighting pin is in its nonsighting position. Preferably, the latching face is formed by a piston member extending radially from the sighting pin. Also, the spring means includes a compression spring surrounding the pin that abuts against the supporting block at one end and the piston member at its other end.

The improved bow sight enables an archer to shoot with a high degree of accuracy, while at the same time permitting quick and easy adjustment to readily compensate for any selected shooting distance as well as for windage.

Other objects and advantages of the present invention will appear during the course of the following description.

DESCRIPTION OF THE PREFERRED EMBODIMENT

Figure 1:
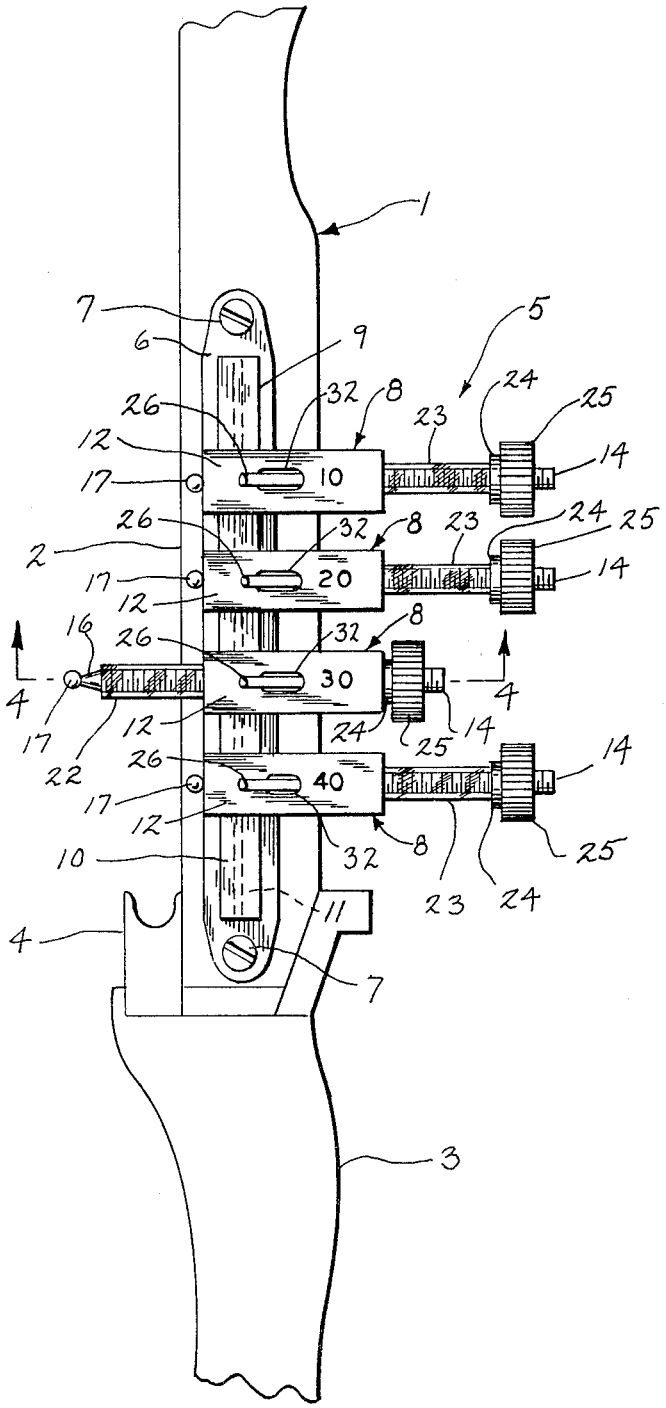
FIG. 1 is a fragmentary rear view in elevation of a bow incorporating a bow sight in accordance with the present invention.

Referring now to the drawings, FIG. 1 illustrates a conventional bow 1 having a central body portion 2, a gripping portion 3 beneath the central body portion 2 and an arrow rest 4. The structure and operation of the bow 1 is well known and thus need not be further described.

Secured to the rear face of the central body portion 2 is a bow sight 5 in accordance with the present invention. As shown in FIG. 1, the bow sight 5 is illustrated as being mounted to the rear face of the central body portion 2 of bow 1. However, it is readily apparent to those skilled in the art that the bow sight 5 may also be mounted on the front face of the central portion 2 of the bow 1 and still be operable in accordance with the present invention. Further, bow sight 5 of the present invention may be utilized with a conventional bow having a simple string arrangement as well as with a compound bow having a complex string and pulley arrangement. Also, it is readily apparent that the bow sight of the present invention may be utilized by both right handed as well as left handed archers.

Figure 2:
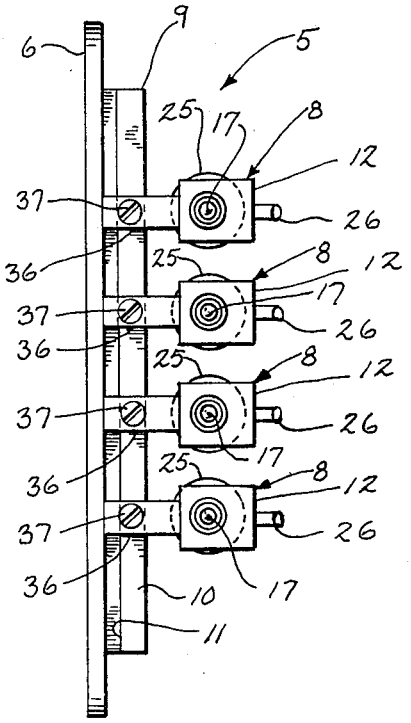
FIG. 2 is a fragmentary side view in elevation of the bow sight of FIG. 1.

As shown in FIG. 1, the bow sight 5 comprises a base plate 6 secured at its opposite ends by a pair of screws 7 to the rear face of the central body portion 2 of bow 1, and a plurality of identical sight assemblies 8 removably mounted on base plate 6. As seen in FIG. 2, base plate 6 includes a raised portion 9 along substantially its entire length. Raised portion 9 has a pair of opposite side faces 10 (only one of which is shown) and a groove 11 formed along the entire length of each face 10, the purpose of which will hereinafter be described.

Figure 3:
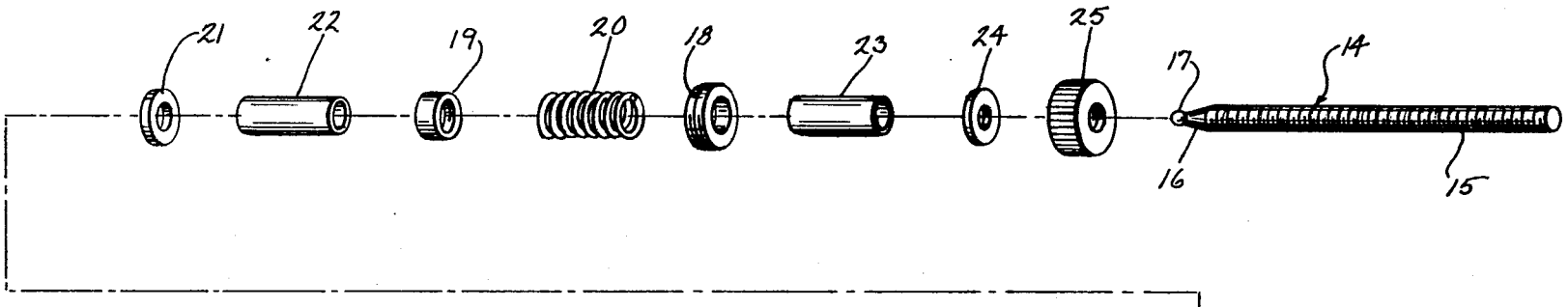
FIG. 3 is an exploded view of any of the sight assemblies of the bow sight.
Figure 3:
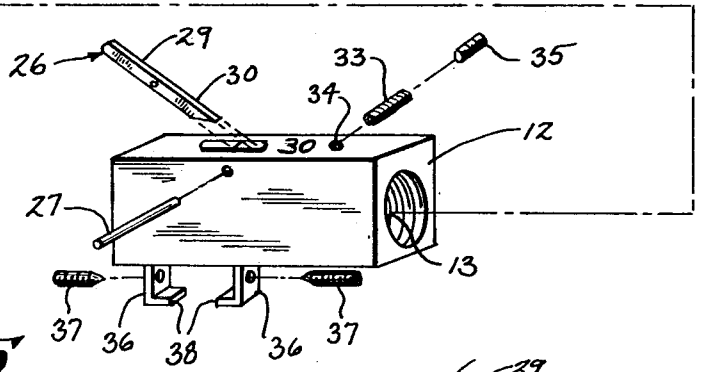
Figure 4:
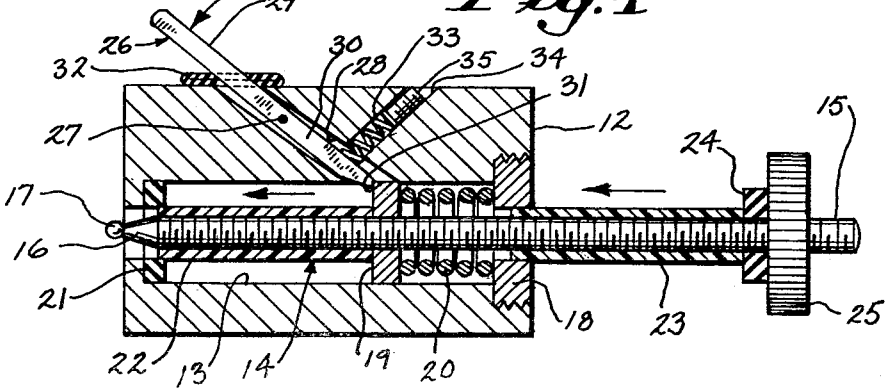
FIG. 4 is an enlarged view in cross section of one of the sight assemblies of the bow sight showing the sighting pin in its nonsighting position.
Figure 5:
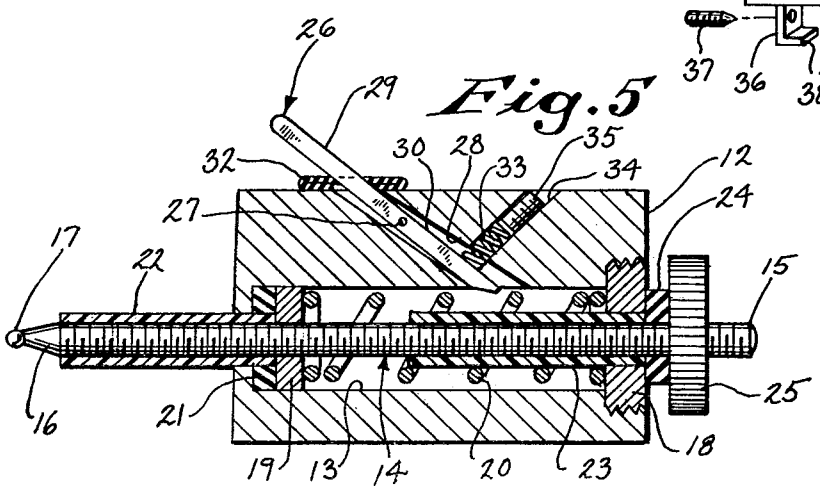
FIG. 5 is a view similar to FIG. 4 showing the sighting pin in its sighting position.

Referring now to FIGS. 3–5, there is shown one sight assembly 8 for the bow sight 5 of the present invention. Each assembly 8 includes a sight support in the form of a supporting block 12 having a transverse bore 13 formed therethrough which slidably receives a sighting pin 14 for longitudinal movement therein. In a preferred embodiment, the bore 13 has a diameter that is greater than the pin 14 in order to accommodate the other components of the assembly 8. Sighting pin 14 has a threaded shaft 15 and a tapered head 16 having a sighting bead 17 formed thereon. Pin 14 is supported at its head end by the end wall of supporting block 12 and at its other end by means of a threaded washer screwed into transverse bore 13. Pin 14 also includes a piston member 19 threadedly engaged on its shaft 15 and extending radially therefrom within bore 13. Piston member 19 forms a shoulder or latching face 31 extending from pin 14, the purpose of which will hereinafter be described.

Sighting pin 14 is movable between a sighting position, shown in FIG. 5, and a nonsighting position, shown in FIG. 4, by a spring means in the form of a compression spring 20. Spring 20 surrounds pin 14 and is housed within block 12 in bore 13. One end of spring 20 abuts against washer 18 and the other end of spring 20 abuts against piston member 19. Spring 20 is positioned so that it urges pin 14 into its sighting position, and as shown in FIG. 4, is thus compressed when pin 14 is in its nonsighting position. A piston stop 21 in the form of a stationary rubber washer is also provided at the head end of bore 13.

As previously noted, sighting pin 14 is threaded and when pin 14 slides between its sighting and nonsighting positions within bore 13 these threads would normally rub against sight pin stop 18 and piston stop 21 thus hindering pin 14 from readily sliding between its two positions. To reduce this friction, pin 14 is surrounded by a pair of plastic sight pin covers 22 and 23. Thus, FIGS. 4 and 5 show that sight pin cover 22 allows pin 14 to readily slide through piston stop 21, and sight pin cover 23 readily permits pin 14 to slide through washer 18.

Pin 14 also includes a rubber stop member 24 encircling its shaft outside of block 12. Stop member 24 serves to engage washer 18 when pin 14 is in its sighting position to stop pin 14 at a previously adjusted position. Thus, stop member 24 limits the extent to which the sighting bead 17 projects laterally from block 12.

As an adjusting means for compensating for windage, pin 14 includes an adjusting knob 25 threadedly engaged on its threaded shaft. Knob 25 may be either turned down upon pin 14 and move stop member 24 to the right, as seen in FIG. 4, which will shorten the distance sighting bead 17 projects from block 12, or may be turned in the reverse direction to the left, as seen in FIG. 4, which will lengthen the distance sighting bead 17 projects from block 12. Thus, the rotation of adjusting knob 25 moves sighting bead 17 laterally to correct or compensate for windage.

The sight assembly shown in FIGS. 3–5, also includes a latch means for releasably engaging sighting pin 14. As seen best in FIGS. 3 and 4, the latch means includes a lever 26 pivotally mounted on block 12 by means of a pin 27. Lever 26 extends obliquely with respect to the longitudinal axis of pin 14 and is pivotally mounted in a bore 28 formed in block 12 which communicates with the transverse bore 13 in block 12. Lever 26 includes a first arm portion 29 extending from block 12 and a second arm portion extending into block 12. The tip of second arm portion 30 extends into transverse bore 13 and engages the latching face 31 formed by piston member 19 when pin 14 is in its nonsighting position as shown in FIG. 4. A rubber sealant 32 such as silicone is placed around the first arm portion 29 of lever 26 at the upper end of bore 28 to prevent foreign material and moisture from entering the bores 13 and 28.

Lever 26 is normally biased into its latching position wherein the tip of its second arm portion 30 engages latching face 31 by means of a small compression spring 33 pushing against the second arm portion 30. Spring 33 is disposed in a threaded bore 34 that extends between the surface of block 12 and bore 28 and is also disposed obliquely with respect to pin 14 but in a direction opposite to that of bore 28. The amount of force supplied by spring 33 against second arm portion 30 of lever 26 may be adjusted by means of an adjusting screw 35 threadedly engaged in bore 34. Thus, the further adjusting screw 35 is turned down into bore 34 the greater the force applied by spring 33 against lever 26. As shown in FIG. 4, lever 26 is in its latching position wherein the second arm portion 30 engages latching face 31 of piston member 19. To move lever 26 into its disengaged or unlatched position, lever 26 is manually pivoted counterclockwise as shown in FIG. 4 so that the tip of second arm portion 30 disengages latching face 31. This permits sighting pin 14 to be forced to its sighting position, i.e., to the left as shown in FIG. 5, by means of compression spring 20.

A means for mounting the sight assembly 8 on base plate 6 is also provided. This mounting means includes a pair of spaced parallel legs 36 extending from block 12 which straddle either side of base plate 6, and a pair of mounting screws 37. Each leg 36 includes a projection 38 that extends inwardly from its outer end and projects into a corresponding groove 11 in base plate 6. Once the projections 38 are positioned in the grooves 11, the mounting screws 37 may be turned down against the side face 10 of base plate 6 to securely mount the sight assembly 8 in any desired position. Thus, sight assembly 8 may be readily positioned on base plate 6 to the exact location corresponding to a particular yardage desired by merely loosening mounting screws 37 sliding the block 12 along the grooves 11, and retightening the screws 37 at the desired position.

As is apparent from the previous description, each spring 20 and latch means combines to provide a pin biasing means for the sighting pins 14. Thus, each pin 14 is spring-loaded for nearly instantaneous movement or transfer between its nonsighting and sighting positions.

In operation, the sight assemblies 8 of the present invention must first be "sighted in" into their proper vertically spaced positions on base plate 6. The "sighting in" procedure generally takes place at a location where an archer can stand at predetermined distances from a target. The positioning of the sight assemblies 8 is determined by experimentation, and is well known in the art and therefore need not be described herein except for the operation of each sight assembly 8 of the bow sight of the present invention. It is sufficient to state that the highest sighting assembly 8 corresponds to the shortest range while the lowest sighting assembly 8 corresponds to the longest range. As shown in FIG. 1, the uppermost sight assembly 8 may correspond to a distance of ten yards and therefore may contain the indicia "10" thereon. The remaining sight assemblies 8 would have their own identifying indicia thereon depending upon the distance desired by the archer. For example, FIG. 1 shows four sight assemblies 8 having the indicia corresponding to ten, twenty, thirty and forty yards.

The operation of the sight assemblies 8 will now be described. Each sighting pin 14 will normally be in its nonsighting position as shown in FIG. 4. In this position compression spring 20 is compressed and the second arm portion 30 of lever 26 engages the latching face 31 of piston member 19 to hold pin 14 in its non-sighting position. When it is desired to release pin 14 an archer merely pivots lever 26 in a counterclockwise direction as shown in FIG. 4 so that the tip of second arm portion 30 becomes disengaged from latching face 31. This allows spring 20 to force pin 14 to the left as shown in FIG. 4 into its sighting position as shown in FIG. 5. Pin 14 slides to the left until stop member 24 engages washer 18. To return pin 14 to its non-sighting position, the archer merely pulls on the adjusting knob 25 until lever 26 once again engages latching face 31.

A preferred embodiment for a bow sight has been shown and described. It is readily obvious to those skilled in the art that substitutions of various components as well as other modifications may be made to the invention as described herein. For example, the latching face 31 need not be formed by the piston member 19 extending from the surface of pin 14, but instead may be formed integrally as a shoulder in the shaft of pin 14. Also, compression spring 20 need not be surrounding pin 14 as described but may be disposed in other positions wherein it still urges pin 14 into its sighting position.

Various modes of carrying out the invention are contemplated as being within the scope of the following claims particularly pointing out and distinctly claiming the subject matter which is regarded as the invention.

I claim:

1. A bow sight comprising:

a sight support including a supporting block having a bore formed therein;

a sighting pin slideably received within said bore of said sight support and movable between a sighting position and a non-sighting position;

spring means including a compression spring surrounding said pin and housed within said bore for urging said pin into its said sighting position;

latch means mounted on said sight support and with said latch means having a pin-engaging portion movable between an operative position engaged with said pin whereby said pin is held in its said non-sighting position and an inoperative position disengaged from said pin whereby said pin is released and said spring means forces said pin to its sighting position;

said pin including a radially projecting latching face formed by one side of a piston member fixedly connected to said pin, and with said latching face engaging said pin-engaging portion of said latch means; and means for mounting said sight support on a bow.

2. The bow sight of claim 1 wherein said latch means is pivotally mounted in a second bore which is disposed in said block and which extends obliquely relative to and communicates with said first-named bore.

3. The bow sight of claim 2 which includes:

means for biasing said latch means into latching position for engagement with said latching face of said pin;

said biasing means including a compression spring mounted in a third bore which is disposed in said block and which extends obliquely relative to said pin in a direction opposite to said second bore.

4. A bow sight, comprising:

a base plate;

means for mounting said base plate on a bow;

a sight supporting block having a bore formed therethrough;

means for removably mounting said supporting block on the base plate;

a sighting pin slideably mounted in said bore and movable in a plane extending transversely of the body of said bow between a sighting position and a non-sighting position;

spring means housed within said bore for urging said pin into its sighting position;

latch means pivotally mounted on the sight support having a pin-engaging portion movable between an operative position engaged with said pin whereby said pin is held in its non-sighting position and an inoperative position disengaged from said pin whereby said pin is released and said spring means forces said pin to its sighting position;

said latch means including a lever pivotally mounted on said block having a first arm portion and a second arm portion containing said pin-engaging portion, and said pin including a radially projecting latching face that engages said pin-engaging portion of said second arm portion when said pin is in its non-sighting position;

lever biasing means for biasing said lever into its operative position;

a stop member mounted on said pin for limiting the sliding movement of said pin;

and an adjusting means for adjusting the position of said stop member on said pin.

5. The bow sight of claim 4, wherein said pin is threaded and said adjusting means includes an adjusting knob threadedly engaged with the threads on said pin for movement along the longitudinal axis of said pin.

6. The bow sight of claim 5 which includes:

a stop member disposed at one end of said bore and a washer disposed at the other end of said bore, said pin extending through said stop member and said washer; and friction reducing cover means disposed on said pin for sliding through said stop member and said washer with said pin when the latter moves between said non-operative and operative positions.

7. A bow sight comprising:

a sight support including a supporting block having a bore formed therein;

a sighting pin slideably received within said bore of said sight support and movable between a sighting position and a non-sighting position;

spring means for urging said pin into its said sighting position;

latch means mounted on said sight support and with said latch means having a pin-engaging portion movable between an operative position engaged with said pin whereby said pin is held in its said non-sighting position and an inoperative position disengaged from said pin whereby said pin is released and said spring means forces said pin to its sighting position;

said pin including a radially projecting latching face engaging said pin-engaging portion of said latch means;

said latch means being pivotally mounted in a second bore which is disposed in said block and which extends obliquely relative to and communicates with said first-named bore; and means for biasing said latch means into latching position for engagement with said latching face of said pin;

said biasing means including a compression spring mounted in a third bore which is disposed in said block and which extends obliquely relative to said pin in a direction opposite to said second bore.

* * * * *